US009061171B2

(12) United States Patent
Hsieh

(10) Patent No.: US 9,061,171 B2
(45) Date of Patent: Jun. 23, 2015

(54) HYBRID ELECTRIC WEIGHT DEVICE

(71) Applicant: CHIA HUA FITNESS CO., LTD., Hsinchu County (TW)

(72) Inventor: Li-Min Hsieh, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 179 days.

(21) Appl. No.: 13/952,772

(22) Filed: Jul. 29, 2013

(65) Prior Publication Data

US 2015/0031505 A1 Jan. 29, 2015

(51) Int. Cl.

| | |
|---|---|
| ***A63B 21/005*** | (2006.01) |
| ***A63B 24/00*** | (2006.01) |
| *A63B 21/04* | (2006.01) |
| *A63B 21/02* | (2006.01) |

(52) U.S. Cl.

CPC ..... *A63B 24/0087* (2013.01); *A63B 2024/009* (2013.01); *A63B 21/0435* (2013.01); *A63B 21/02* (2013.01)

(58) Field of Classification Search

CPC ..... A63B 21/02; A63B 21/026; A63B 21/04; A63B 21/0407; A63B 21/0414; A63B 21/0421; A63B 21/0428; A63B 21/0435; A63B 24/0062; A63B 24/0065; A63B 24/0068; A63B 24/0087

USPC ..... 482/1–9, 92–94, 98–100, 133–139, 482/142; 601/23, 24, 26, 33–35; 73/1.08, 73/1.15, 862.381

See application file for complete search history.

(56) References Cited

U.S. PATENT DOCUMENTS

| | | | | |
|---|---|---|---|---|
| 5,356,353 | A * | 10/1994 | Takaoka | 482/9 |
| 5,788,605 | A * | 8/1998 | Kuo | 482/5 |
| 5,993,356 | A * | 11/1999 | Houston et al. | 482/4 |
| 6,244,999 | B1 * | 6/2001 | Alessandri | 482/142 |
| 7,678,022 | B1 * | 3/2010 | Hsieh | 482/5 |
| 7,682,287 | B1 * | 3/2010 | Hsieh | 482/5 |
| 2010/0216600 | A1 * | 8/2010 | Noffsinger et al. | 482/5 |
| 2011/0172058 | A1 * | 7/2011 | Deaconu et al. | 482/5 |
| 2012/0231929 | A1 * | 9/2012 | Hsieh | 482/5 |
| 2012/0231930 | A1 * | 9/2012 | Hsieh | 482/6 |

* cited by examiner

*Primary Examiner* — Stephen Crow
*Assistant Examiner* — Gregory Winter
(74) *Attorney, Agent, or Firm* — Rosenberg, Klein & Lee

(57) ABSTRACT

A hybrid electric weight device applying to exercise equipment, including a frame body, a load mechanism having a main shaft, a motor torque member and a spring member, a force mechanism having at least a set of rods, load cells and handles, an acceleration processing board having an acceleration sensor and a microprocessor, a digital watch arranged on the frame body for users inputting an exercise set value; and a servo controller. When operating the force mechanism, the users feel the load generated by both the motor torque member and the spring member of the load mechanism, and the; the servo controller continues to compare differences in the value of the load cell, digital watch and acceleration processing board and then corrects the current value to drive the motor torque member.

6 Claims, 7 Drawing Sheets

HYBRID ELECTRIC WEIGHT DEVICE

BACKGROUND OF THE INVENTION

1. Field of the Invention

The invention relates to a hybrid electric weight device with a combination of a motor torque member, spring member and electric servo system to simulate a traditional weight plate, applying to muscle training devices and fitness equipment.

2. Description of the Related Art

Regardless of recreation, health or professional reasons, fitness exercise is an important part of our life. For example, strength trainers have become very popular in developed countries in Europe and America, and iron weight plates are used as a resistance device to provide required exercise load for the users, building up muscles. However, using the weight plate as the resistance device has many shortcomings. For example, the iron weight plate comes with a large volume and occupies much space. It takes much time and effort to make the adjustment of the load. When the iron plate is moved up and down, an annoying sound will be produced substantially. The iron plate is a weight load and thus the load cannot be changed by setting an exercise curve. When the heartbeat rate exceeds a specified limit, the load cannot be reduced automatically and immediately.

Moreover, a spring is a simple and inexpensive component of the kinetic energy storage and release and has been used in the fitness equipment for many years but its elastic force is not fixed and it is difficult to adjust, which does not meet the needs of rapid and continuous changes in the weight for exercising. In addition, the spring is lack of smooth feel of the iron plate in the exercise.

In recent years, many creators have disclosed a motor-style fitness equipment with automatic load devices for improving iron load and the spring load, such as the TW Patent No. 230359 of the inventor, U.S. Pat. No. 4,979,733 and No. 4,678,184. Although the motor automatic load device can improve the above partial shortcomings, there is a slow pace phenomenon in the recovery process after applying force, and a lack of sense of speed from the load of iron plate. Therefore, the motor automatic load device is still unable to meet the needs of the user.

Due to the improvement of life quality, the fitness equipment not only were asked not to interfere with the environment but also were asked for high demands for protecting the safety of the users. In addition, the user operable roundness and smooth feeling are main demands for a new generation of fitness equipment. Therefore, how to apply the advantage of saving kinetic energy of the spring and combine the motor torque to reduce energy consumption and reduce the cost of system hardware, and how to apply the servo controller to simulate the fitness demand of the users for allowing the users to get a sense of the speed of movement and the smooth sense of operation become the objectives of the present invention.

SUMMARY OF THE INVENTION

It is a primary object of the present invention to provide a hybrid electric weight device to combine kinetic energy of a motor torque member and spring member as a load mechanism to reduce energy consumption of the exercise equipment and reduce system costs.

It is another object of the present invention to provide a hybrid electric weight device to apply a servo controller to provide the exercise equipment with a sense of movement speed and smooth operation.

In order to achieve the above objects, the hybrid electric weight device includes a frame body having a seat thereon; a load mechanism fixed on the frame body and having a main shaft, a motor torque member and a spring member respectively mounted on the main shaft for generating a load on the main shaft; a force mechanism fixed on the main shaft and having at least a set of rods, load cells and handles for users applying a force to the main shaft; an acceleration processing board having an acceleration sensor and a microprocessor mounted on the load cell of the force mechanism; a digital watch arranged on the frame body for users inputting an exercise set value; and a servo controller mounted on the frame body and electrically connected to the acceleration processing board, the load cell, the motor torque member and the digital watch; whereby when operating the force mechanism, the users feel the load generated by both motor torque member and spring member of the load mechanism; the servo controller continues to compare differences in the value of the load cell, digital watch and acceleration processing board and then corrects the current value to drive the motor torque member.

Based on the features disclosed, the motor torque member includes a motor and a hollow gear box. The motor may be a DC motor or a brushless motor and may have a motor spindle. The hollow gear box is connected to the motor spindle for transmitting the torque thereof and has a hollow core; the main shaft penetrates the hollow core and is driven by the hollow core.

Further, the spring member includes a spring arm, at least a tension spring and a spring mount; the tension spring has both ends respectively mounted at the spring arm and a free end of the spring mount; the spring arm has a fixed end mounted to the main shaft is twisted by the main shaft; the spring mount has a fixed end fixed to the frame body.

Further, the spring member includes a driven sleeve and at least a scroll spring; the driven sleeve mounted to the main shaft is twisted by the main shaft; the scroll spring having an inner end inserting to a slot and an outer end fixed on the frame body.

DETAILED DESCRIPTION OF THE PREFERRED EMBODIMENT

Figure 1:
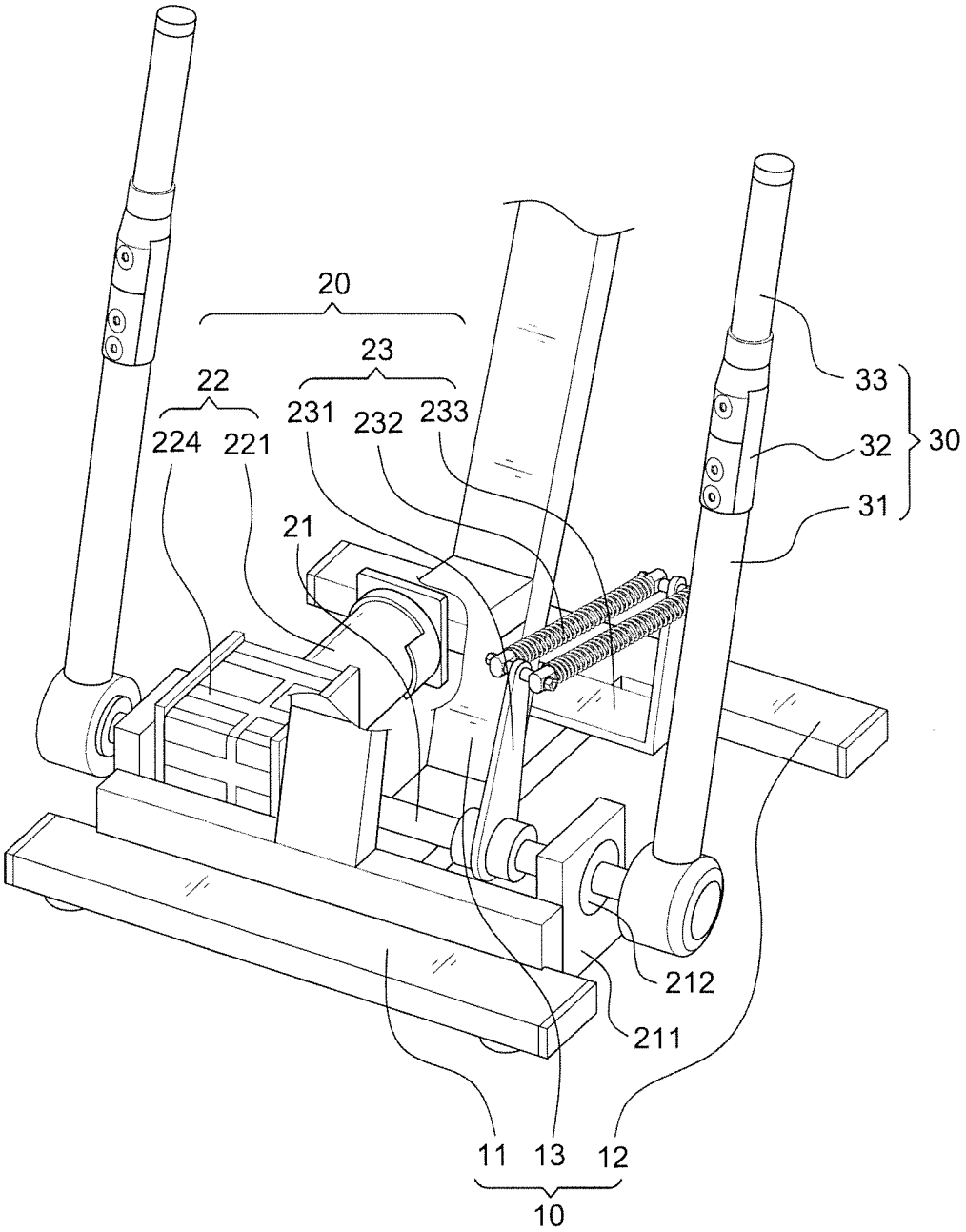
FIG. 1 is an assembly perspective view of an applicable embodiment in accordance with the present invention.
Figure 2:
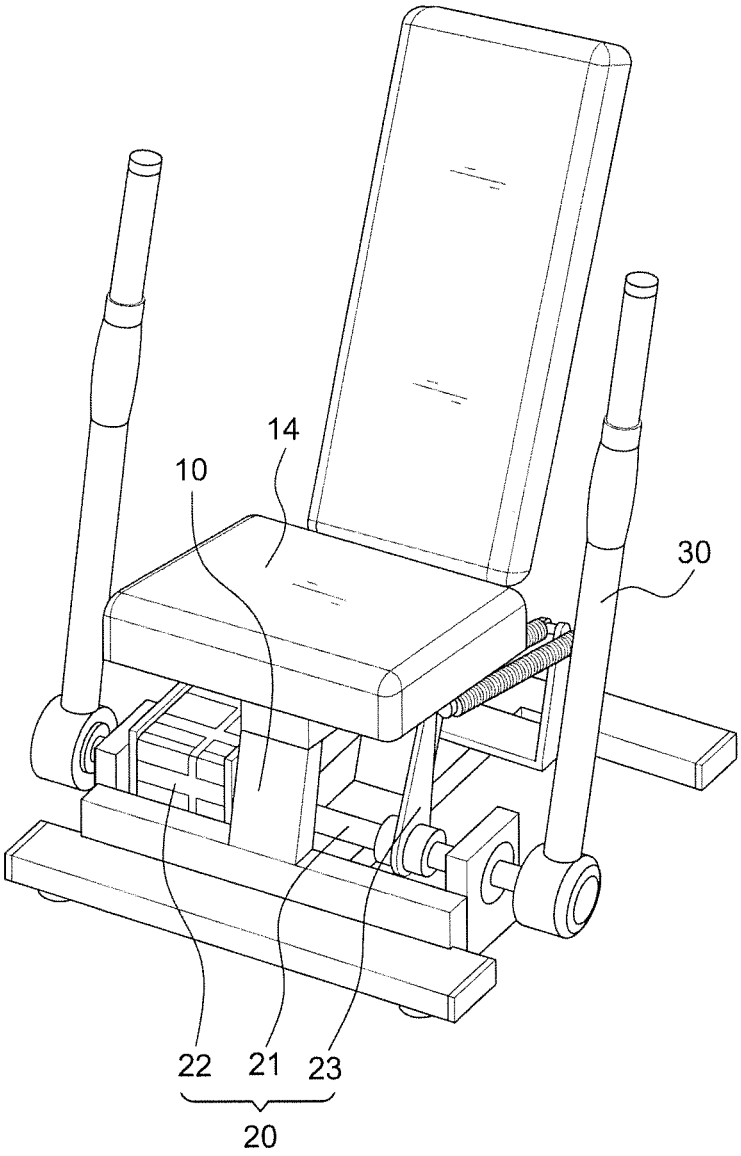
FIG. 2 is an appearance view of an applicable embodiment in accordance with the present invention.
Figure 3:
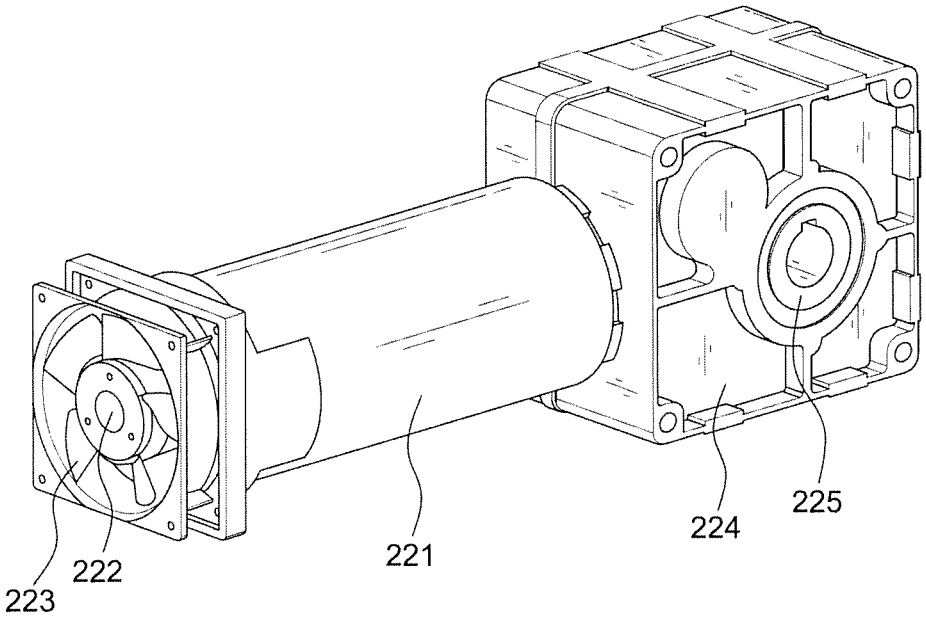
FIG. 3 an assembly perspective view of a motor torque member in accordance with the present invention.
Figure 4:
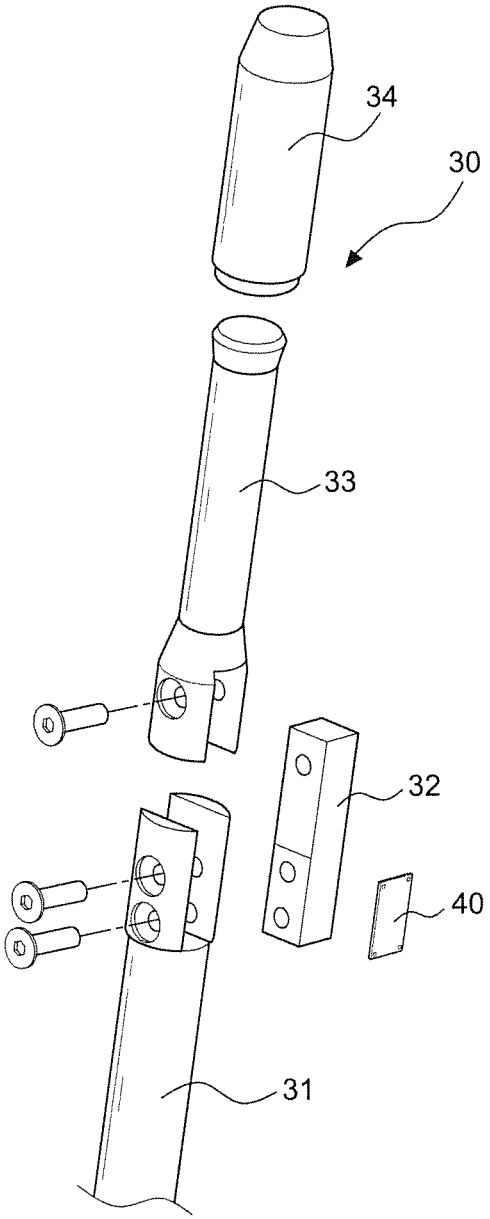
FIG. 4 is an exploded perspective view of a force mechanism in accordance with the present invention.
Figure 5:
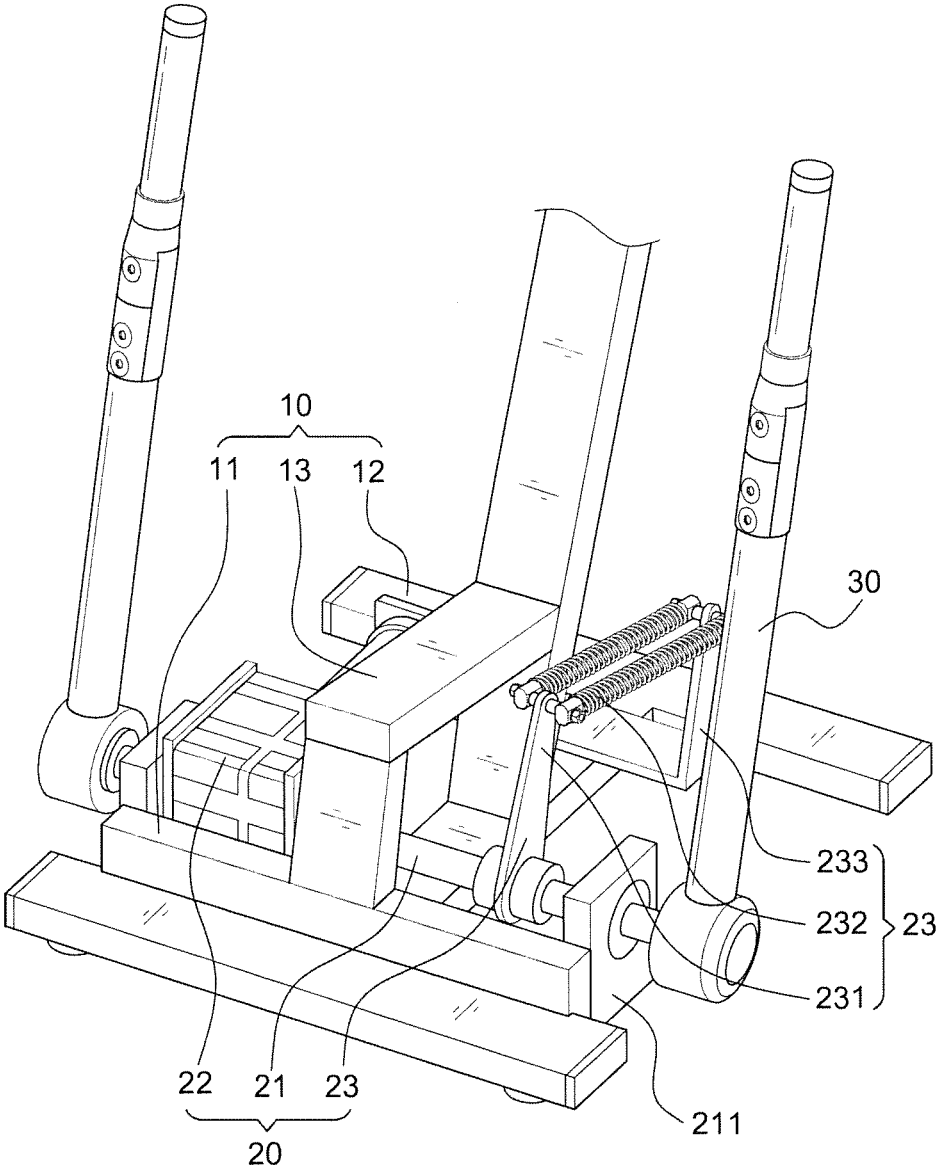
FIG. 5 is an assembly perspective view of a first embodiment in accordance with the present invention.
Figure 6:
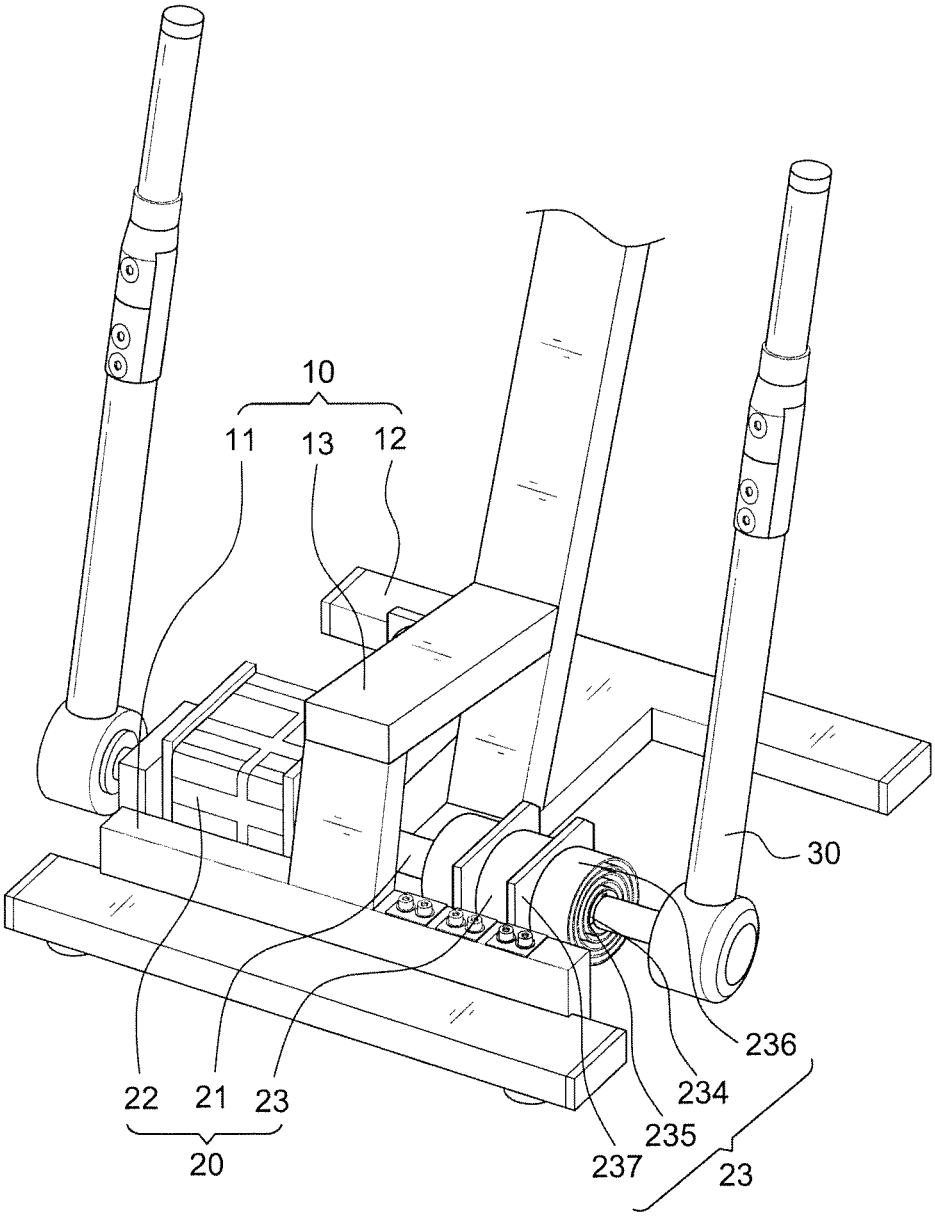
FIG. 6 is an assembly perspective view of a second embodiment in accordance with the present invention.

Referring to FIGS. 1 through 6, the applicable embodiment of a hybrid electric weight device in accordance with the present invention comprises a frame body 10, a load mechanism 20, a force mechanism 30, an acceleration processing board 40, a digital watch 50 and a servo controller 60.

The frame body 10 includes a front frame 11, a rear frame 12 and a vertical frame 13 connected to the front frame and rear frame 11, 12 and having a seat 14 thereon;

The load mechanism 20 includes a main shaft 21, a motor torque member 22 and a spring member 23 respectively mounted on the main shaft 21 for generating a load on the main shaft 21. The main shaft 21 has a shaft seat 211 at both ends thereof respectively fixed at a rear side of the front frame 11 and the shaft seat 211 has a shaft bearing 212 mounted in center thereof for the main shaft 21 pivoting thereon. The motor torque member 22 includes a motor 221 and a hollow gear box 224. The motor 221, a DC motor or a brushless motor, has a motor spindle 222 and an end connected to a fan 223 for cooling the motor 221. The hollow gear box 224 is connected to the motor spindle 222 for transmitting the torque thereof and has a side fixed to the shaft seat 211 for indirectly fixing the motor torque member 22 to the frame body 10. The hollow gear box 224 has a hollow core 225 for the main shaft 21 penetrating and the main shaft 21 is driven by the hollow core 225 to transmit the torque of the motor 221 to the main shaft 21. In the first embodiment, the spring member 23 includes a spring arm 231, at least a tension spring 232 and a spring mount 233 and the tension spring 232 has both ends respectively mounted at the spring arm 231 and a free end of the spring mount 233. The spring arm 231 having a fixed end mounted to the main shaft 21 is twisted by the main shaft 21. The spring mount 233 has a fixed end fixed to a front side of the rear frame 12. In the second embodiment, the spring member 23 includes a driven sleeve 234 and a plurality of scroll springs 236 and a partition 237 is provided between the each set of the scroll springs 236 for isolation. The driven sleeve 234 mounted to the main shaft 21 is twisted by the main shaft 21 and the scroll spring 236 has an inner end inserting to a slot 235 of the driven sleeve 234 and an outer end fixed on the front frame 11.

The force mechanism 30 is fixed on the main shaft 21. In the applicable embodiment, the force mechanism 30 is a set of symmetrical rod bodies including a rod 31, load cell 32, handle 33 and handle sleeve 34 around an external edge of the handle 33. The rod 31 has a fixed end mounted to the end of the main shaft 21. The load cell 32 in this applicable embodiment is a beam load cell having an end fixed to a lower end of the handle 33 and another end fixed to a free end of the rod 31; whereby, a load force of the load mechanism 20 is transmitted from the main shaft 21 and the rod 31 to a lower end of the load cell 32 while an external force of users is transmitted from the handle 33 to an upper end of the load cell 32. Thus, when the lower and upper ends of the load cell 32 respectively bear the load force and the external force, a strain is produced from the load cell 32 and the strain value is transmitted to the servo controller 60 for applying.

The acceleration processing board 40 has an acceleration sensor 41 and a microprocessor 42 mounted at a side of the load cell 32 of the force mechanism 30.

The digital watch 50 is arranged on the frame body 10 for users inputting an exercise set value.

Figure 7:
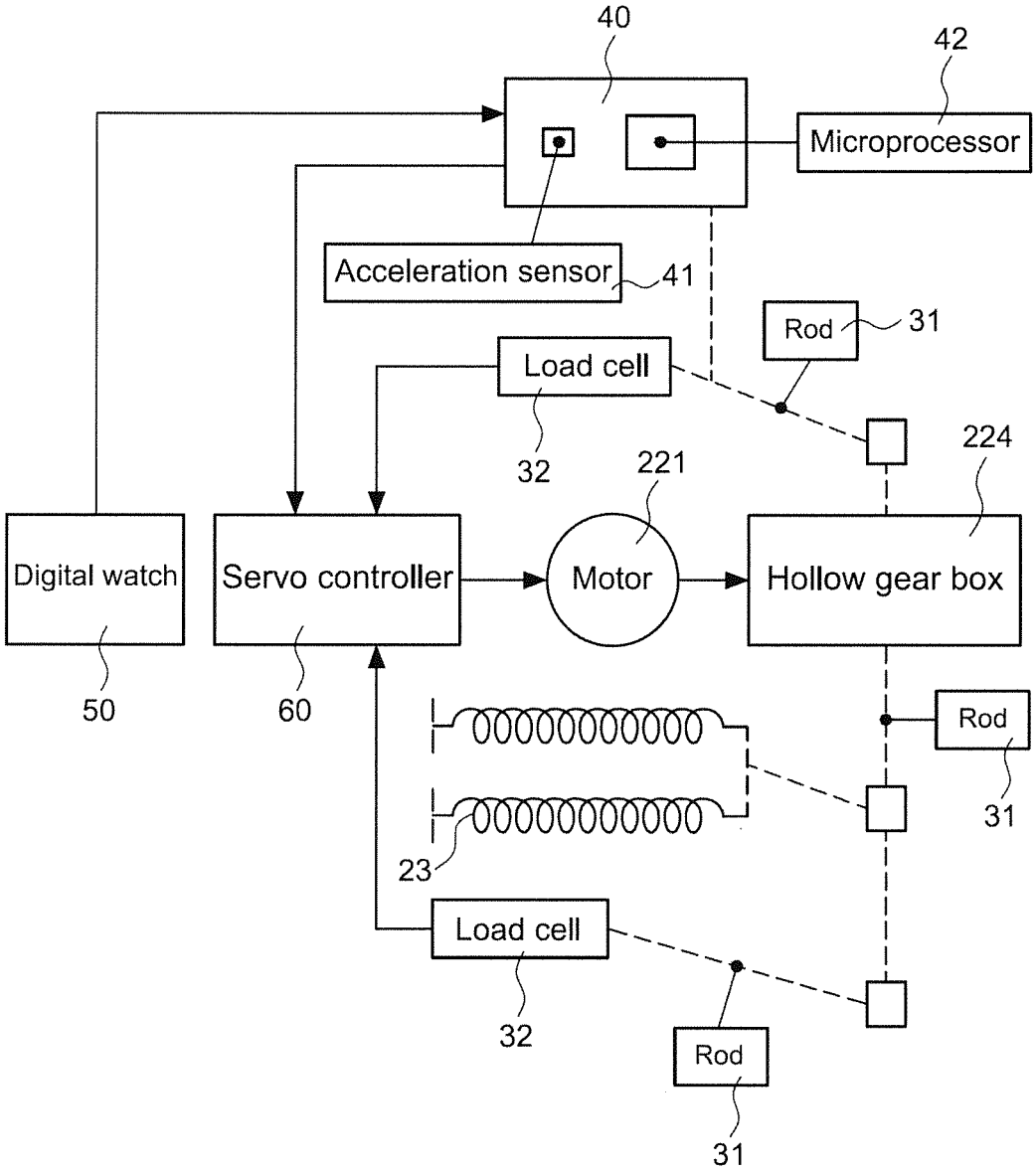
FIG. 7 is a schematic view of an electrical connection in accordance with the present invention.

The servo controller 60 as shown in FIG. 7 is mounted on the frame body 10 and electrically connected to the acceleration processing board 40, the load cell, the motor torque member 22 and the digital watch 50.

When operating the force mechanism, the users feel the load generated by both motor torque member 22 and spring member 23 of the load mechanism 20 and the load cell 32 mounted in the force mechanism 30 simultaneously bears the load converted into a signal S1 to be transmitted to the servo controller 60. Comparing the signal S1 and the exercise set value S2, an error value |S1−S2| therebetween is enlarged as a current to drive the motor 221. The load from an output torque acting on the shaft 21 minus the load the spring member 23 acting on the main shaft 21 is equal to the exercise set value S2. Further, the acceleration sensor 41 simultaneously senses an acceleration of the force mechanism 30. According to Newton's second law, the exercise value is calculated based on the acceleration value by the microprocessor 42. The resulting value added to the exercise value is transmitted to the servo controller 60 and is compared to the external force sensed by the load cell 32. The error value after cooperation is enlarged as the current to drive the motor 221. Due to the spring assistance, nearly half overall output of the motor willed be saved and half capacity of motor force mechanism will be reduced for substantially reducing hardware costs.

The present invention combines the spring member, motor torque member and servo controller to achieve smooth operation, having the following advantages:

1. compared to the pure electrical servo system, the present invention saves half output power to meet the concept of green energy;

2. with the motor and hollow gear box constituted by the motor torque member, the capacity of the present invention is only one half of the pure electrical servo system, effectively reducing hardware costs;

3. the present invention improves the shortcoming of the pure spring or pure iron plate which is unable to set an exercise curve.

Based on the features disclosed, the present invention is provided not only for reducing energy consumption of the exercise equipment but also for having a sense of the speed of movement and the smooth sense of operation while using the exercise equipment.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A hybrid electric weight device applying to exercise equipment, comprising:

a frame body having a seat thereon;

a load mechanism fixed on the frame body and having a main shaft, a motor torque member and a spring member respectively mounted on the main shaft for generating a load on the main shaft;

a force mechanism fixed on the main shaft and having at least a set of rods, load cells and handles for users applying a force to the main shaft;

an acceleration processing board having an acceleration sensor and a microprocessor mounted on the load cell of the force mechanism;

a digital watch arranged on the frame body for users inputting an exercise set value; and a servo controller mounted on the frame body and electrically connected to the acceleration processing board, the load cell, the motor torque member and the digital watch;

whereby when operating the force mechanism, the users feel the load generated by both the motor torque member and the spring member of the load mechanism, and the servo controller continues to compare differences in the value of the load cell, digital watch and acceleration processing board and then corrects a current value to drive the motor torque member.

2. The hybrid electric weight device as claimed in claim 1, wherein the motor torque member includes a motor and a hollow gear box; the motor is a DC motor or a brushless motor and has a motor spindle; the hollow gear box is connected to the motor spindle for transmitting the torque thereof and has a hollow core; the main shaft penetrates the hollow core and is driven by the hollow core.

3. The hybrid electric weight device as claimed in claim 2, wherein the spring member includes a spring arm, at least one tension spring and a spring mount; the tension spring has both ends respectively mounted at the spring arm and a free end of the spring mount; the spring arm has a fixed end mounted to the main shaft that is twisted by the main shaft; the spring mount has a fixed end fixed to the frame body.

4. The hybrid electric weight device as claimed in claim 1, wherein the spring member includes a driven sleeve and at least one scroll spring; the driven sleeve mounted to the main shaft is twisted by the main shaft; the scroll spring having an inner end inserting to a slot and an outer end fixed on the frame body.

5. The hybrid electric weight device as claimed in claim 4, wherein the at least one scroll spring is a plural set and a partition is provided between the pluralities of the scroll springs.

6. The hybrid electric weight device as claimed in claim 1, wherein the load cell is a beam load cell.

* * * * *